US006588022B1

(12) United States Patent
Anders et al.

(10) Patent No.: US 6,588,022 B1
(45) Date of Patent: Jul. 8, 2003

(54) HEAD DOME AND STRAP CONNECTION SYSTEM

(76) Inventors: Bruce Anders, P.O. Box 546, Bethel, AK (US) 99559; Ernesto E. Blanco, 36 Sandrick Rd., Belmont, MA (US) 02478; Irving Anders, 2163 Southern Ct., Cottage Grove, WI (US) 53527; Scott Blackburn, 101 Indian Trail, Scituate, MA (US) 02066; David Miller, 9 Francis St., Brookline, MA (US) 02446

( * ) Notice: Subject to any disclaimer, the term of this patent is extended or adjusted under 35 U.S.C. 154(b) by 0 days.

(21) Appl. No.: 09/567,625

(22) Filed: May 9, 2000

(51) Int. Cl.[7] ..... A42B 3/08; A42B 1/08; A63B 71/10

(52) U.S. Cl. ..... 2/421; 2/424; 2/425

(58) Field of Search ..... 2/410, 455, 411, 2/414, 421, 422, 424, 425

(56) References Cited

U.S. PATENT DOCUMENTS 4,236,514 A * 12/1980 Moretti ..... 2/205 X
5,715,541 A * 2/1998 Landau ..... 2/425

* cited by examiner

*Primary Examiner*—Peter Nerbun

(57) ABSTRACT

The present invention provides a system of head and spine protection conceptually different from, and superior to, the traditional free-floating helmet concept, for use in high impact physical activities, such as such as football, hockey, lacrosse, motorcycling, downhill skiing, bobsledding/luge, cycling, snowmobiling, race car driving, factory/construction activities, firefighting, skydiving, and training/battlefield activities by the military and law enforcement officers. The head dome and connection system provides a clear or tinted, impact-proof, projectile-proof bubble over the head and neck, which is secured firmly to the wearer's shoulders and torso via a connection system of straps to a harness, or to the waistline/upper thighs. The head is protected from impact against the inside of the dome by a cushioned cap, secured in place with a chin strap. The head dome can contain, in various embodiments, climate controlling features, solution-treated surfaces to prevent visual obfuscation from fog/ice/water beads, heat resistant construction for firefighting applications, radio/digital communication options, and a self-contained breathing apparatus. The head dome and connection system thus keeps the entire face, head, neck and cervical/upper thoracic portion of the spine free from the injurious impacts from exterior forces, objects and projectiles, while preserving the wearer's freedom of head movement, unobstructed vision, enhanced communication options, and comfort. Inside the head dome, the wearer's head and neck movement and interaction with his or her surroundings are virtually as unimpeded as if there were no head protection whatsoever.

15 Claims, 7 Drawing Sheets

HEAD DOME AND STRAP CONNECTION SYSTEM

BACKGROUND OF THE INVENTION

1. Field of the Invention

The present invention provides a system of head and spine protection conceptually different from, and superior to, the traditional free-floating helmet concept, for use in high impact physical activities, such as such as football, hockey, lacrosse, motorcycling, downhill skiing, bobsledding/luge, cycling, snowmobiling, race car driving, factory/construction activities, firefighting, skydiving, and training/battlefield activities by the military and law enforcement officers. The head dome and connection system provides a clear or tinted, impact-proof, projectile-proof bubble over the head and neck, which is secured firmly to the wearer's shoulders and torso via a connection system of straps to a harness or to the waistline/upper thighs. The head is protected from impact against the inside of the dome by a cushioned cap, secured in place with a chin strap. The head dome can contain, in various embodiments, climate controlling features, solution-treated surfaces to prevent visual obfuscation from fog/ice/water beads, heat resistant construction for firefighting applications, radio/digital communication options, and a self-contained breathing apparatus. The head dome and connection system thus keeps the entire face, head, neck and cervical/upper thoracic portion of the spine free from the injurious impacts from exterior forces, objects and projectiles, while preserving the wearer's freedom of head movement, unobstructed vision, enhanced communication options, and comfort. Inside the head dome, the wearer's head and neck movement and interaction with his or her surroundings are virtually as unimpeded if there were no head protection whatsoever.

2. Description of the Prior Art

It is commonly known that many contact sports, such as football, hockey and lacrosse, and other vigorous physical activities, such as motorcycling, downhill skiing, bobsledding/luge, cycling, snowmobiling, race car driving, factory and construction activities, skydiving, training/battlefield activities engaged in by members of the military, and training/street activities engaged in by law enforcement officers, and other dangerous activities, such as firefighting, can subject the human head and spine to powerful external forces from moving and/or stationary objects.

For example, in American football, the player's head is routinely stopped abruptly while the shoulders and the rest of the body keep going, thus causing the neck to buckle from excessive axial loading and compression. When the bubble strikes an object, the shoulders will absorb the load rather than the top of the head, since the head will have no contact with the bubble. The head will still stop abruptly, just as in the current helmet shoulders will absorb the load rather than the top of the head, since the head will have no contact with the bubble. The head will still stop abruptly, just as in the current helmet design, however the shoulders will stop as well. Therefore the neck will not compress, and the chance of the neck buckling from even the fiercest hit is almost impossible.

Trauma to the head and neck can lead to a wide range of catastrophic and sometimes fatal injuries. Because the human spinal cord is protected by a series of vertebrae separated by ligaments and cartilage having relatively minor compressive or elastic strength, external forces impacting the spinal process can crush and/or displace the fragile bones and/or soft tissue, and apply shear stresses to the delicate enclosed nerve bundles.

The biomechanics of cervical spine fracture illustrates the dangers of direct head compression, with axial loading and flexion, in high impact physical activities such as football. Normally, when a person stands up straight, the cervical spine has a normal upward curve. However, when an individual lowers his head and bends his neck slightly forward, his cervical spine straightens. The spine then becomes what is called a segmental column. If a force is applied to the top of the head with the spine straightened (axial loading), the spinal element can not dissipate the force through controlled motion. Instead the continued motion of the body will result in the compression in the spine. If the forces are greater than the elastic capability of the spine, the spinal segment will buckle. The result is a fracture and/or dislocation. Thus, when the loading on the crown of the athlete's head plus the velocity of body weight compress the cervical spine, the spine and the spinal cord are literally crushed between the player's head and his body.

Depending upon the strength, angle and duration of such forces, the impact can cause a wide array of serious head and spine injury along the entire length of the spine, resulting, in some cases, in complete quadriplegia, and even in death. It has been reported that 92% of all spinal injuries in athletics result in quadriplegia. The National Spinal Cord Injury Association: Spinal Cord Injury Statistics: http://www.sninalcord.orwresourcemactsheets/factsheec.html. This source reports that each year, 7800 people (or 32 injuries per million population) across the United States suffer spinal cord injuries resulting in at least partial loss of sensation, motor function and bowel and bladder control; in all, 250,000–400,000 individuals live with a spinal cord injury or spinal dysfunction. Sporting activities alone are known to be one of the four leading causes of spinal cord injury, and football activities are one of the most dangerous of all sporting activities.

One investigation into serious head and neck injuries revealed that 54% of all spinal cord injuries in school and college athletics occur in football. Watkins, "Cervical Spine and Spinal Cord Injuries," Sports Injuries: Mechanisms, Prevention and Treatment, Baltimore, Md., Williams & Wilkins Co., 1994. From 1959 to 1963, there were 30 permanent cervical spinal cord injuries in high school and college football. There were 133 permanent cervical spinal cord injuries in high school and college football from 1971–1976, 34 of which occurred in 1976. Torg, J.S., "The Epidemiological, Biomechanical, and Cinematographic Analysis of Football Induced Cervical Spine Trauma," Athletic Training: Journal of National Athletic Trainers Association, National Athletic Trainers Association, 1990, pp. 25–147. There have still been at least 195 football players with incomplete neurological recovery from cervical cord injuries, or on average 9.3 per year since 1976.

The danger is by no means limited to football. On Oct. 20, 1995, Travis Roy, a Boston University freshman hockey player, was paralyzed as a result of skating headfirst into the boards. Or, society has watched the sad plight of actor, Christopher Reeve, following an equestrian accident where he struck his head on the ground after falling from his horse, and his "skull cap" helmet did nothing to blunt the trauma to his cervical spine, rendering him a paraplegic. Devastating and well-known examples of similar incidents abound in downhill skiing accidents, motorcycle accidents, bobsledding accidents, training/battlefield accidents in the military, riot control accidents by police officers, etc.

The tragic statistics concerning spinal cord injuries in contact sports and other impact activities can be blamed almost entirely upon the deficient design of the conventional "helmet." Presently, head protection for dangerous activities is provided by various helmet designs, which typically provide a durable, shock-resistant barrier around the wearer's skull. Such helmets often add a facial visor or guard to provide additional protection to the face. Current football helmets, for example, are made up of a polycarbonate shell, with padding inside the shell, and a face mask attached to the front of the helmet. A chin strap secures the helmet to the player's head. Shoulder pads are added to shield the shoulders from impact, which functions independent of the helmet.

In additional to helmets and shoulder pads, some players wear extra equipment in attempt to protect the neck, such as cervical collars, "cowboy collars," and "neck rolls." Such devices slightly restrict undesired lateral and posterior movement of the player's head and neck, but do not prevent the underlying problem of axial loading or whiplash transmitted from the head to the extremely delicate cervical spine.

The reason is that, because the conventional helmet design is affixed to the skull itself, the neck and spine must absorb the forces of frontal, rear, and lateral impacts delivered from external sources (as well as the weight of the head and the attached helmet). Therefore, when a participant in a vigorous activity encounters moving or stationary force to the head, only the participant's skull area (and face, if the helmet uses a face shield) is protected from the impact. The neck and spine are unsupported and unprotected from these exterior forces, leading to the range of spinal injuries noted above.

Relatively recent improvements, such as raised padding on the shoulder pad area behind the traditional helmet design, are intended to reduce the incidence and severity of injuries describe above by limiting, somewhat, the range of motion of the free-floating helmet. But such helmet motion-impediment designs are of very limited utility for two primary reasons. First, they only limit helmet mobility in one direction (typically protecting against only a squarely frontal blow). Impact from any other direction renders the motion-impediment design worthless. Second, the more these designs attempt to protect the cervical spine by reducing the range of motion of a free-floating helmet, the less useful that helmet becomes to the participant, whose sight, hearing, and freedom of head movement are usually crucial to the activity in which he is engaged.

For these reasons, no present helmet improvement provides a complete stabilization of, and protection to, the face, head and cervical spine process, while still allowing the participant unfettered range of motion of the head, comfort, unimpeded visibility, and enhanced communications options.

SUMMARY OF THE INVENTION

The head dome and connection system provides a clear or tinted, impact-proof, projectile-proof bubble over the head and neck, which is substantially larger than the wearer's head, and which is secured firmly atop the participant's shoulders and torso via a connection system of detachable straps to the waistline or around the upper thighs. The wearer has inches of space between the dome and the wearer's head, allowing the head to move freely inside the dome. When the wearer encounters force to his head or neck from any direction, the dome redirects the force to the shoulders and torso, keeping the cervical portion of the spinal cord free from the injurious stress. This enables the wearer to strike another exterior object with his head, or be stricken in the head by an exterior object or surface, without any possibility of the cervical spine having to absorb the force of the impact. To ensure that neither the wearer's face or head comes into contact with the inside surface of the dome, a cushioned cap is worn to act as an interior buffer device. The head dome can contain, in various embodiments, climate controlling features, heat resistant materials, radio/digital communication options, and a self-contained breathing apparatus. The head dome and connection system thus keeps the entire face, head, and cervical portion of the spine free from the injurious impacts from exterior forces, objects and projectiles, while preserving the participant's freedom of head movement, unobstructed vision, enhanced communication options, and comfort. Wearing the clear head dome, the participant's head and neck movement and interaction with his or her surroundings are virtually as unimpeded if he or she had no head protection whatsoever.

Accordingly, it is an object of the present invention to provide a device that will protect the head, skull, face, spine, neck, and back from multi-directional impact to participants in contact sports (such as football, hockey and lacrosse), and other vigorous physical activities (such as motorcycling, downhill skiing, bobsledding/luge, cycling, snowmobiling, race car driving, factory and construction activities, firefighting skydiving).

It is a further object of the invention to provide the protections listed above using extremely tough, durable materials, capable of withstanding the impacts of other identical units (as in full contact sports applications), stationary objects, or projectiles (including bullets, as in law enforcement or military applications), without significantly deforming, denting, cracking or shattering, thereby protecting the face and head of the wearer.

It is a further object of the invention to provide the protections listed above while allowing the wearer to breath normally.

It is a further object of the invention to minimize the potential for other persons to grab the dome with their hands or for the dome to snag on inanimate objects.

It is a further object of the invention to allow for use in a firefighting context or chemical weapons military/law enforcement, where the dome is hermetically sealed with a self-contained breathing apparatus and is resistant to extreme heat, flames, deadly smoke, gas, and nuclear/biological/chemical agents.

It is a further object of the invention to minimize obstruction to the wearer's vision, either through a decreased field of vision or excessive opacity, while still allowing for logos and/or identification markings to be visible from the exterior.

It is a further object of the invention to allow the system to be worn comfortably, to include compression factors and interior climate.

It is a further object of the invention to provide the wearer adequate ventilation in the system, including air to the wearer and venting moisture.

It is a further object of the invention to allow the unit to contain a communications option.

It is a further object of the invention to provide the protections and features listed above while minimizing the difference in appearance between the present invention and conventional protective head wear devices.

It is a further object of the invention to provide the protections and features listed above while minimizing cost per unit.

BRIEF DESCRIPTION OF THE DRAWINGS

The head dome and connection system is hereafter described with specific reference being made to the drawings in which.

DESCRIPTION OF THE PREFERRED EMBODIMENT

Figure 1:
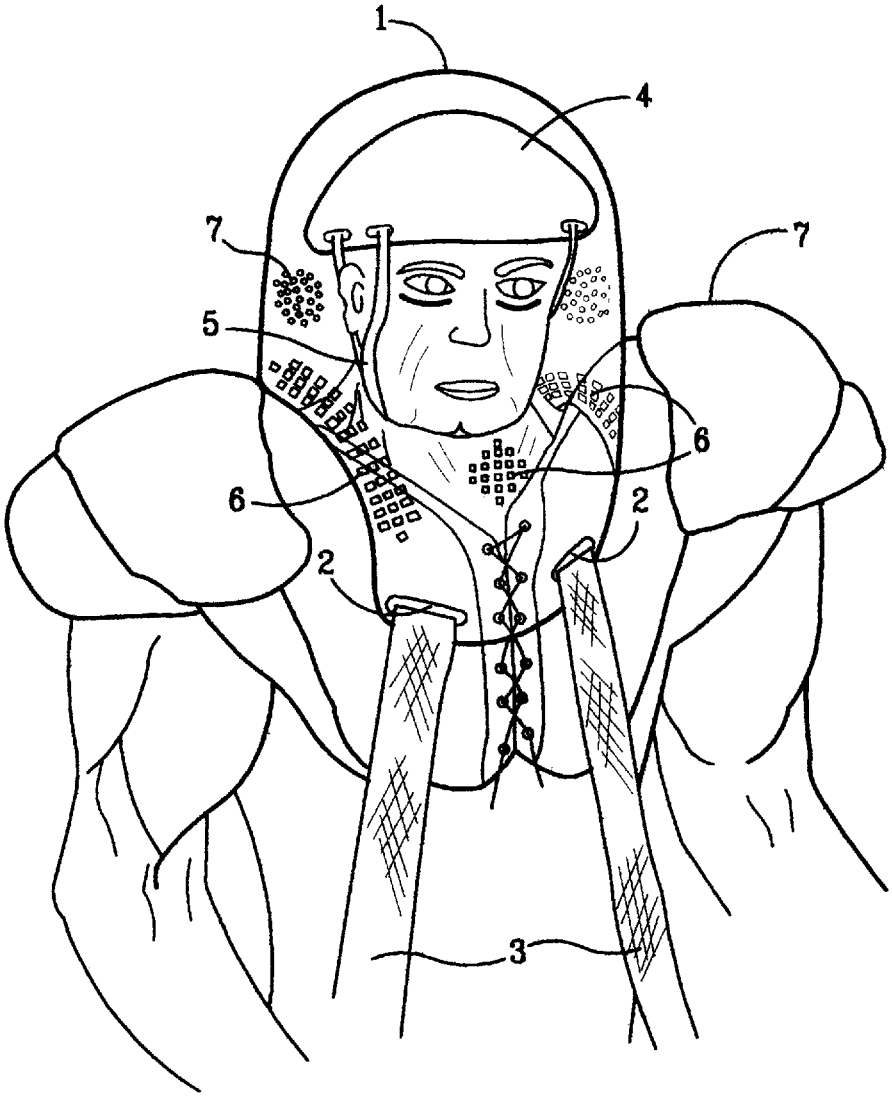
FIG. 1 is a perspective view of the head dome, with ventilation holes and with the cushioned inner cap and upper portion of the connection system as fitted onto a football player with shoulder pads.

While participants in all of the activities noted above can suffer tragic head and spine injuries due to impact from other participants/players, inanimate moving objects, inanimate stationary objects and projectiles, football players are perhaps most visibly and notoriously exposed to such injury. Some of the startling statistics relating to football players' injuries are described above. Thus, FIG. 1 illustrates the head dome and connection system in a football context. This is not intended to act as a limitation of the application of the present invention to a football context. Rather, the head dome and connection system easily can be designed to accommodate the specific needs of virtually any of vigorous physical activity where the face, head or cervical spine is subject to force trauma, such as those noted above in the Description of the Prior Art.

FIG. 1 depicts the hemispherical/cylindrical transparent bubble, or head dome (1). The shape of the head dome as pictured in FIG. 1 represents a most preferred embodiment of the shape. In this embodiment, the top of the head dome is semi-spherical, and extends downwards into a cylindrical shape of the same diameter. Because spherically shaped object has maximal strength, but can distort vision, the cylindrical part of the shell covers the eyes/face to provide optimal visual quality. As with the top of the bubble, an appropriate space separates the cylindrical section of the shell from the player's face at all times. Any forces applied to the face is also dissipated to the shoulders, eliminating stresses that would otherwise be absorbed by the neck.

The cylindrical downward extension portion of the dome extends down the wearer's chest and back, and is firmly affixed to the shoulders. In a football, hockey, lacrosse, motor sports, riot control gear, or other physical activity in which pads are typically worn, the lower rim of the head dome can rest securely on the shoulder pads. This embodiment is depicted in FIG. 1. A curved section of the cylindrical downward extension is cut out in order for the dome to contact snugly onto the shoulder pads, without leaving any appreciable gaps between the dome and the pads.

Figure 2:
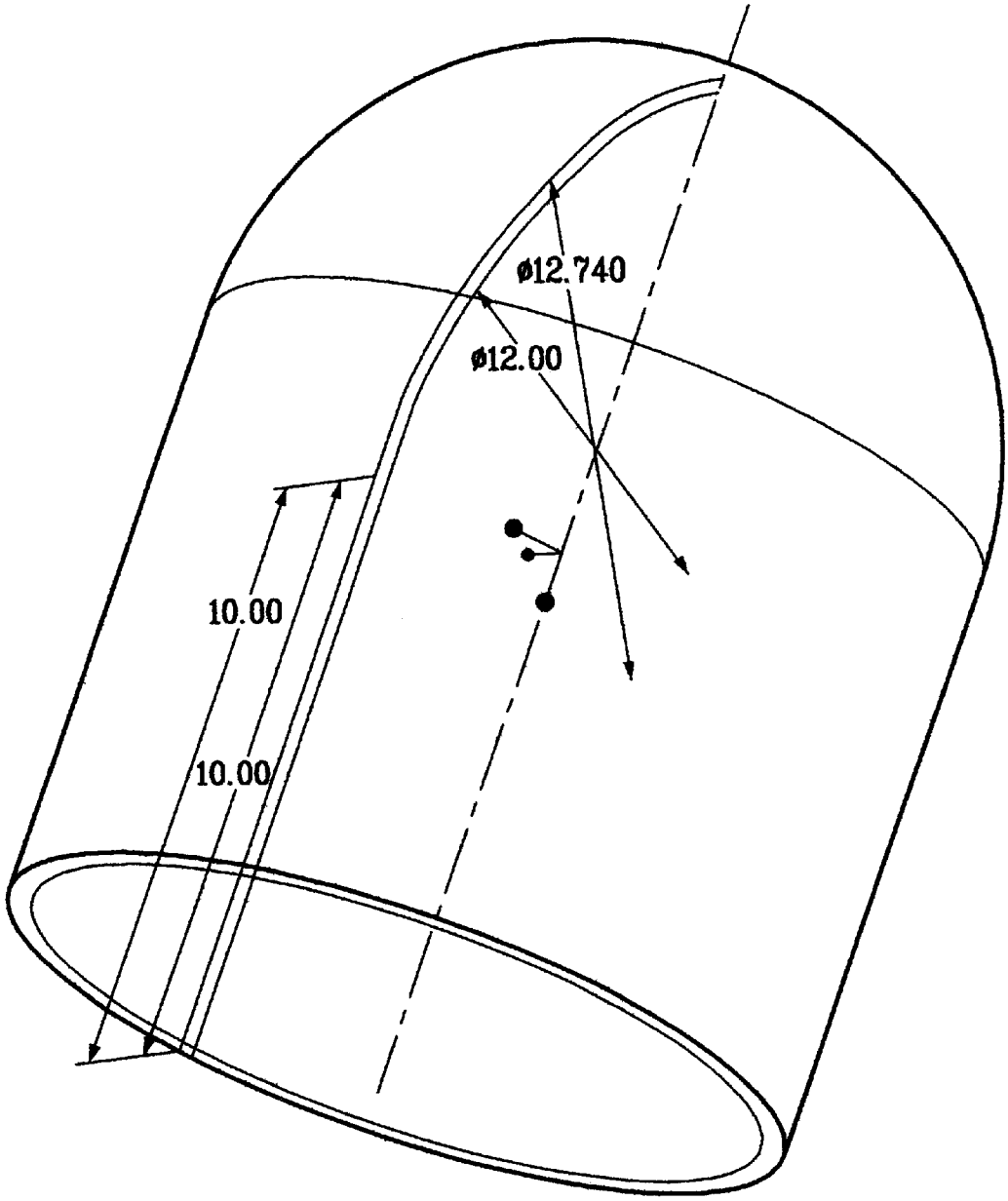
FIG. 2 is an engineering diagram depicting various measurements and angles in one embodiment of the dome.

FIG. 2 depicts some of the engineering specifications for one embodiment of the head dome. As described below, the size and shape of the head dome will vary between users, applications, and requirements.

The disclosed shape and application of the head dome will enable participants to wear eye wear of any kind, to include spectacles, sunglasses, or contact lenses, with minimal possibility of disturbing them during the activity, since no close contact with the head or face will ever occur. This feature provides a significant improvement over conventional helmet designs.

The head dome is constructed of a transparent or tinted, suitably durable, shock-resistant material that will not break, shatter or chip when struck by projectiles (such as rocks, bullets, shrapnel of falling construction materials), or when it strikes stationary objects with great force (such as other head domes in a football context, or the side boards in a hockey context), or when it is hammered, twisted, or bent. The material must be transparent, or, in alternate embodiment, tinted with light and/or UV protection, to allow for the wearer to see easily through it.

In one preferred embodiment, the dome is made of any polycarbonate resin with high impact resistance, dimensional stability, and visual clarity (for example, Lexan® polycarbonate plastic). The head dome requires polycarbonate resin with high impact resistance, dimensional stability, and visual clarity, since it is an amorphous thermoplastic that combines high levels of mechanical, optical, electrical and thermal properties, and is a durable, shock-resistant material that will not break, shatter or chip when struck by projectiles (such as rocks, bullets, or shrapnel), or when it strikes stationary objects with great force, or when it is hammered, twisted, or bent. For example, Lexan® polycarbonate is approximately 250 times stronger than plate glass and 30 times stronger than acrylic of equal thickness. It is unlikely to break, shatter or chip when bombarded with thrown objects such as rocks, bricks, and bottles. Nor is it likely that the material will break when hammered, twisted, or bent. Lexan® polycarbonate plastic is, for example, the material used in some taxicabs and high security buildings to provide a shock- and bullet-resistant barrier between driver/passenger(s) or employee/patron.

However, this is by no means meant to limit the material used to construct the dome to Lexan® polycarbonate plastic. Any appropriately durable, shock/impact-resistant, transparent material could be used that achieve the objects of the invention.

For example, in one alternate embodiment, the dome can be used in a firefighting context. In that context, impacting forces, such as from falling structural pieces or equipment, present a hazard to the firefighters. However, perhaps a greater threat can derive from the deadly smoke, heat and gasses encountered at the scene of the burning structure.

While the head dome concept is applicable to this firefighting scenario, polycarbonate type plastics such as Lexan® would be inappropriate, due to their limited heat resistance. However, other transparent materials, such as a mica aluminum oxide, which can withstand extreme temperatures, can be used in this embodiment.

In another embodiment, the dome can be used in a chemical warfare environment by members of the military and law enforcement. In such an embodiment, the dome would be completely-hermetically sealed, and contain a self-contained breathing apparatus. Such devices are currently used in NASA space suits, U.S. Army chemical munitions protective clothing, and sea diving suits. The dome would also be constructed of a material resistant to deadly smoke, extreme heat, flames, gasses and nuclear/biological/chemical agents.

As noted earlier, the use of the head dome will not unnecessarily impede a participant's free motions, visibility, or communication. In fact, the range of motion enjoyed by a wearer of the head dome and connection system is as good, or better, than that of the wearer of a standard helmet. This is because the participant's head and neck float freely in the protected confines of the dome. Further, the head dome will keep dirt, dust, and mud out of the player's face, eyes, and mouth. The wearer need simply wipe the outside of the shell to clean it.

The diameter of the head dome can vary, as do conventional helmets, to fit various sized heads, from children's sizes to extra large. The diameter is preferably within a range between 8 and 20 inches. Similarly, the size and shape of cutout area fitting over the shoulder pads can vary, depending upon which type of shoulder pads are being used.

The thickness of the material comprising dome must be wide enough to accomplish the protective and other goals of the present invention, listed above. However, it should be thin enough to minimize, to the extent practicable, distortion in clarity, unnecessary weight and difficulty in construction. Depending upon its application, the thickness of the dome can vary. For example, in a military or law enforcement context, projectile-resistance is likely a more important goal than weight minimization, in which case the dome would be of a relatively great thickness. In other athletic contexts, by contrast, weight reduction and visual clarity are of relatively high importance, resulting in a slightly thinner dome. And, as the head dome concept is applicable to all athletic endeavors in which the head and neck are possibly subject to force trauma, a wide spectrum of functionally effective widths are appropriate. For example, a football player, who will be repeatedly and continually slamming his head and neck into other players' domes with full body force, will likely require a head dome of greater thickness than that worn by a lacrosse player, whose head contact is infrequent, and whose points of possible contact are relatively softer. However, the thickness of the head dome material should be, depending upon usage, within a preferred range of between approximately 8 and 20 millimeters.

To securely hold the dome onto the shoulders of the wearer, a "connection system" is used. Referring to FIG. 1, The connection system consists of four fastener slots (2), four fastener straps (3), and a harness system (discussed below). Two fastener slots are cut into the front wing of the curved section of the cylindrical downward extension, and two are cut into the rear wing (hidden behind the football player in the diagram). The four fastener straps are looped through the front and rear fastener slots, and extend downward to the a harness system. The straps can be of any sufficient strapping material, such as polyester, cotton or nylon, but in a most preferred embodiment, should have an elasticity. Elastic straps, which typically use a series of rubber strands interspersed throughout the inelastic material, is well known to those skilled in the art, and can have varying degrees of elasticity. The degree of elasticity required in the present invention is that the straps must be elastic enough to firmly hold the head dome down onto the wearer's shoulders, while providing enough elasticity to enable the wearer to bend in all directions comfortably.

Because frontal, rear and/or lateral impact can cause the participant's head to bounce or whiplash inside the dome, a cushioned head cap (4), constructed of soft, comfortable, suitably cushioning or inflatable material, which, provides a soft padding for the head within the confines of the head dome when the head is bounced around due to jostling or trauma. When external forces cause to head to snap in any direction, the head cap cushions any impact of the skull against the inner surface of the dome. Thus, the wearer is able to move his head freely within the protective dome, interacting with the surroundings just as if he did not have any head protection at all, while still being completely protected from the risks of excessive axial loading or whiplash. No part of the dome comes in contact with the head or face. In order to protect the mouth, and specifically the teeth, a mouth-guard is also necessary. Just as in current helmets, the mouth-guard is a separate entity used inside the mouth during play and stored while not in play.

The head cap should not be coated with a solid material, as this may result in unnecessary scratches to the interior surface of the head dome when exterior forces cause the wearer's head cap to strike the interior of the dome. The head cap is secured to the participant's head, in one preferred embodiment through means such as a head cap chin strap (5).

Ventilation of air into and out of the dome can be provided by small ventilation holes (6). The ventilation holes will allow a free flow of oxygen into and carbon dioxide out from the dome, allowing the wearer to breathe normally. The ventilation holes also serve to maintain visibility within the dome, by venting moisture and gasses. The interior of the head dome should be treated with an "anti-fog" solution, known to those skilled in the art, to further prevent vision obstruction by fogging and icing. The exterior of the front of the dome, particularly the area around the face, can be treated with a solution that prevents the beading of water, known to those skilled in the art, such as the solutions used on automobile and aircraft windshields.

The ventilation holes cannot be of excessive diameter. As noted above, one object of the invention is to minimize the potential for other persons to grab the dome with their hands or for the dome to snag on inanimate objects. This feature would eliminate the extremely dangerous and injurious "face mask" maneuver in sports such as football and lacrosse, and would minimize risk in hand-to-hand combat activities such as those engaged in by law enforcement and military personnel. The smoother the surface of the dome, the less opportunity for human hands or inanimate objects to ensnare the dome. Thus, the ventilation holes should be of a diameter sufficient to achieve their purpose, allowing a free flow of air into and out from the dome, while being small enough to prevent a human finger from penetrating the hole and grasping the dome. The preferred range of ventilation hole diameter is thus between 1 and 5 mm..

To prevent the wearer's sense of hearing being dulled by being enclosed in a solid bubble, the dome has a discreet area in the vicinity of each ear, here two series of small holes or squares are cut out of the material. These environmental sound vent holes (7) allow the wearer to hear surrounding sounds with relatively little interference.

Figure 3:
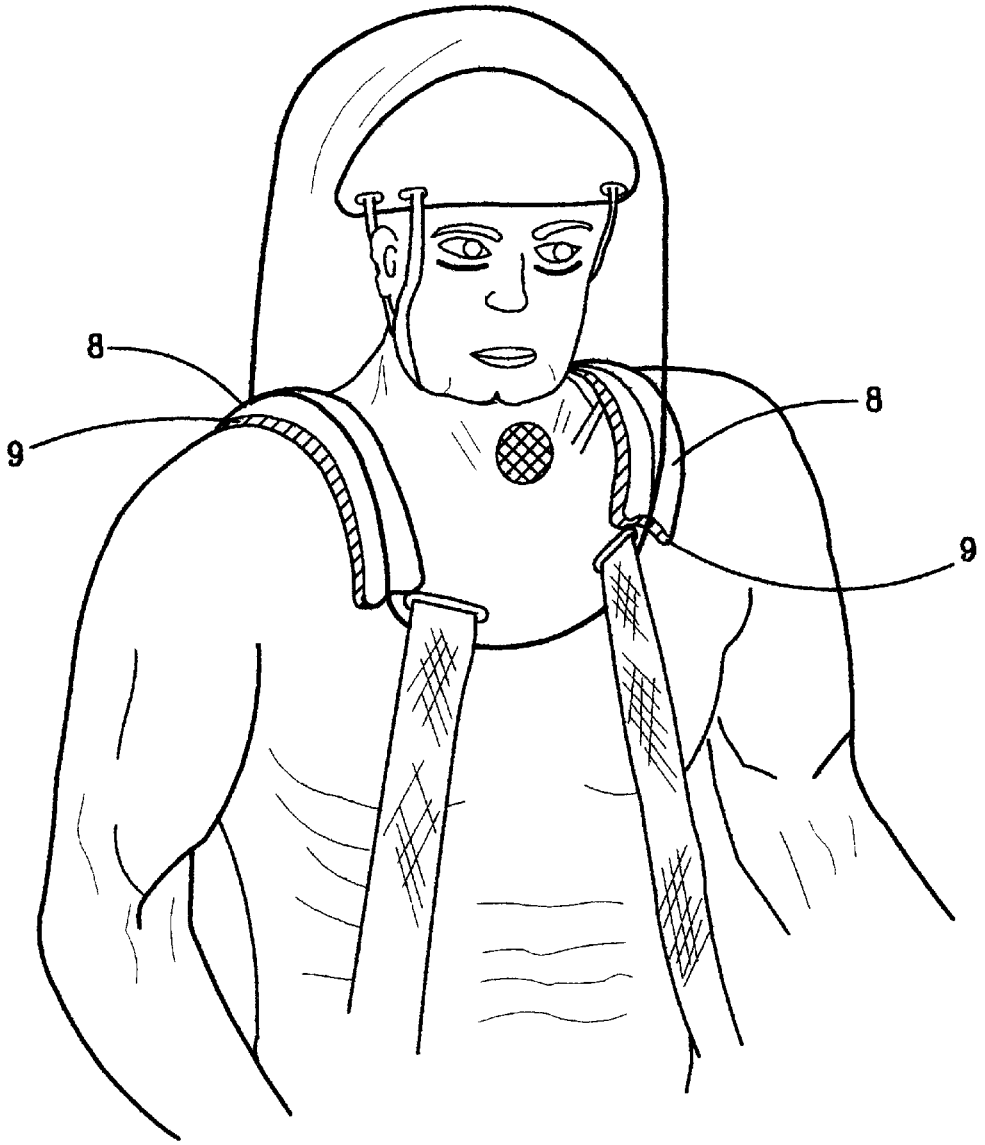
FIG. 3 is a perspective view of the head dome system using padded shoulder ridges.

In contexts where shoulder pads are not conventionally worn, such as downhill skiing, such shoulder pads could be borrowed from other applications. In an alternative embodiment, shown in FIG. 3, the lower edges of the curved dome is cushioned by use of a perpendicular ridge (8), between 1 and 6 inches, which has thick ridge padding material (9) permanently attached underneath. The padding material can be made of a number of synthetic foaming or padding materials, such as polyurethane or rubber. In this embodiment, the head dome would not require the use of separate plated shoulder pads, since the padded, ridged curved lower rim of the dome rests directly onto the wearer's clothing, and provides adequate surface area over the wearer's shoulders to comfortably distribute the forces on the dome to the surface of the shoulders. As the diameter of the head dome can vary to fit various sized heads, from children's sizes to extra large, the size and shape of the ridged cutout area fitting over the shoulder pads can vary, depending upon the sized shoulders of the user.

Figure 4:
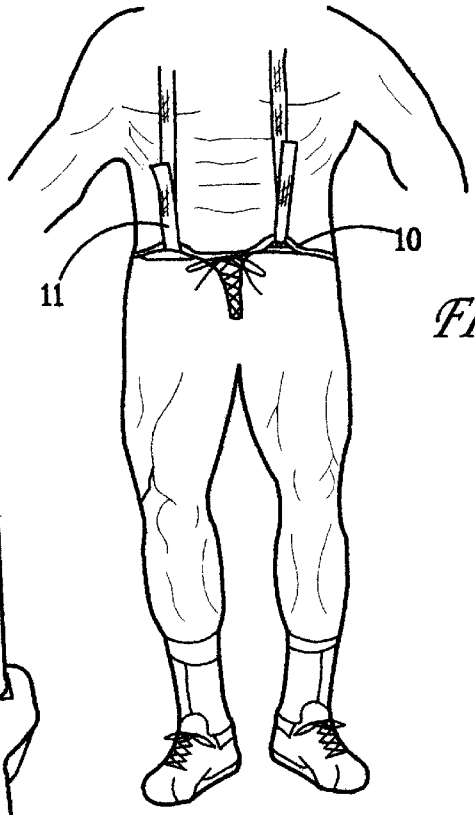
FIG. 4 is a perspective view of the lower portion of the connection system as embodied in a pants loop clip design, and a Velcro® strap attachment/adjustment system.
Figure 5:
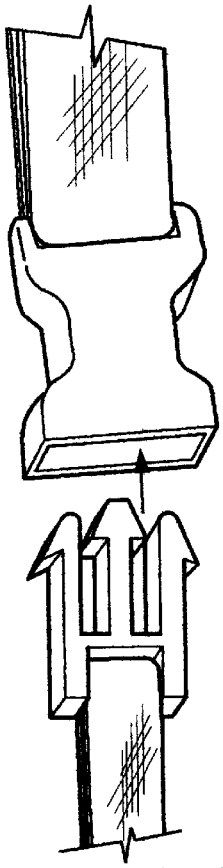
FIG. 5 is a side elevational closeup view of the alligator clip technology design for use in attaching and adjusting the fastener straps.

The harness system secures the four fastener straps on a stable lower body anchor on the wearer's legs and hips. The fastener straps, which are firmly affixed to the fastener strap slots, extend downward, and are attached via an adjustable strap-length system. In a preferred embodiment, each fastener strap extends downward, and loops through a rigid horizontal pants loop (10), sewn onto the wearer's conventional pants. FIG. 4. The horizontal pants loop is constructed of very tough textile, such as canvas, and sewed onto the upper rim of the pants to ensure it can withstand the force of the strap constantly pulling upward, with extreme periodic stresses as the head dome is hit laterally. The bottom portion of each faster strap must have adjustable capability. This adjustability can be achieved by using instant adhesion technology, such as Velcro® (11), or can use a cinching force tension system, such as those used on camping equipment or lash-down technology, or can use "alligator-type" locking clips, such as that shown in FIG. 5.

Figure 6:
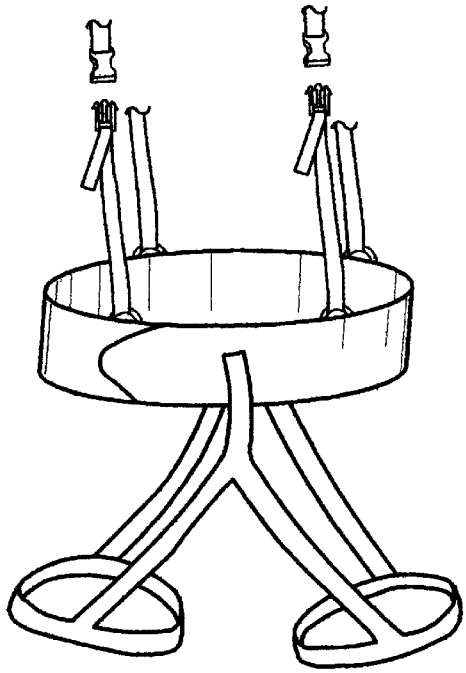
FIG. 6 is a side elevational view of the harness embodiment, with fastener straps attached, using the alligator clip design for attaching and adjusting the fastener straps.

In an alternative embodiment, the harness system could use a separate harness, such as the type used in rock climbing or parachuting contexts. FIG. 6. In this embodiment, the user would don the harness when ready to wear the head dome, and would attach and tighten the straps when ready to engage in the physical activity. The advantage of the harness system over the horizontal pants loop system is that the harness system most effectively distributes the vertical pull force of the straps over the entire hip/waist/upper leg area of the wearer, which increases comfort. Additionally, as these harnesses are typically used to support several times the weight of the user, they would provide sufficient strength to ensure that the head dome was securely down onto the shoulders of the wearer until the wearer intentionally detached it.

Figure 7:
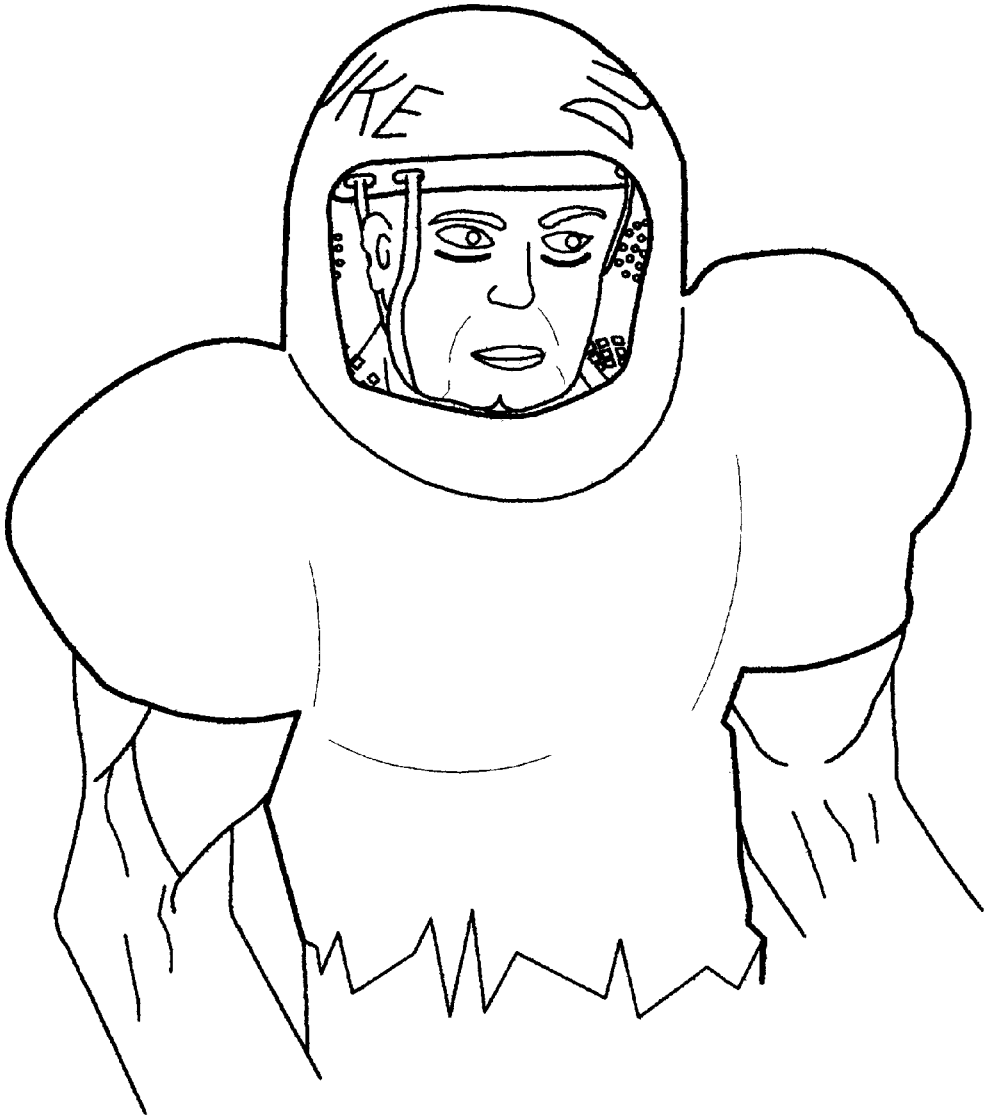
FIG. 7 is a perspective view of the head dome system as worn by a football player with a logo painted on the dome and a jersey hiding the lower portion of the dome's extension wings.
Figure 8:
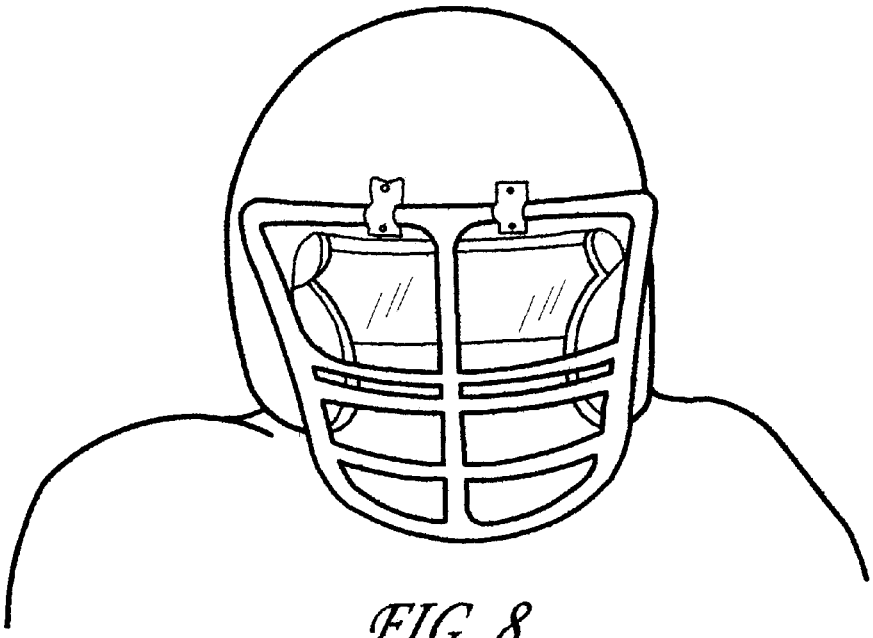
FIGS. 8 and 9 are perspective views of the alternative embodiment of the shape of the dome, where the face area is cut out and replaced by a conventional football helmet face mask, as compared to a convention lineman face mask football helmet.
Figure 9:
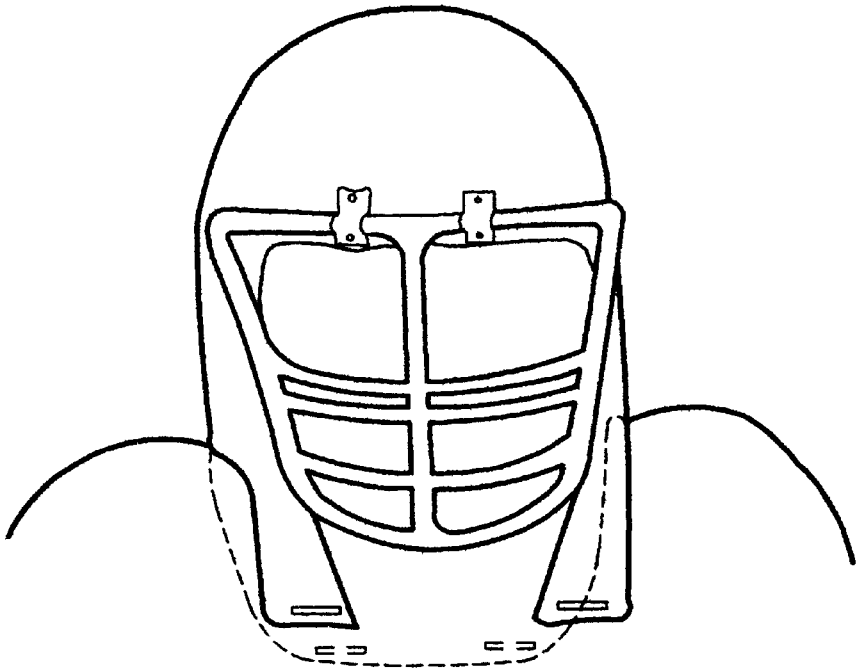

It is an object of the invention to provide the cervical protections of the head dome, while minimizing the difference in appearance between the present invention and conventional protective head wear devices. The present invention can be painted and marked in a way that achieves this object. In FIG. 7, the present invention is depicted as it would with the football jersey covering the lower Further, the shape of the head dome itself can vary drastically from the shape depicted in FIG. 1, while still not departing from the spirit of the invention. A different shape of the head dome may be necessary for utilitarian purposes, for example, to minimize size, or to house additional components, such as the climate control unit, discussed below. Or, the dome's shape can be altered for aesthetic purposes. For example, it may be desirable to duplicate, to the extent possible, the American football helmet. The current American football helmet as used by linemen is depicted in FIG. 8. FIG. 9 depicts a conventional-appearing face mask head dome, adapted to closely approximate the appearance of the current football helmet.

A few of the advantages are lost in this embodiment of the shape of the head dome. For example, the embodiment pictured in FIG. 9 would not provide a smooth surface, which, as discussed, would make a "face mask" injury virtually impossible. Also, the advantage of providing full-face protection is lost in this embodiment. However, the embodiment provides gains in other areas. As mentioned, this embodiment of the head dome is virtually identical in appearance to the currently used football helmet. Moreover, significantly more air can pass into and out from the dome, perhaps obviating the need for some of the ventilation and climate control devices set forth below. Also, this embodiment would allow the wearer to touch his face and head without removing the head dome.

Figure 10:
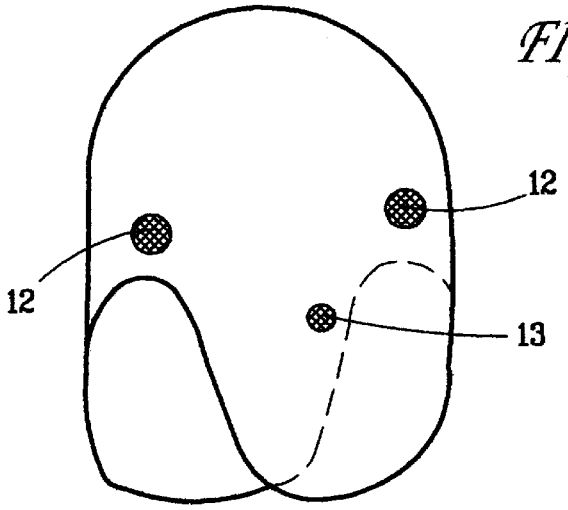
FIG. 10 is a side elevational view of the optional communications system that could be housed within the dome.

In an alternative embodiment, FIG. 10, the head dome can come equipped with small sound projection devices (12), mounted onto the area of the dome near the ears. The sound projection devices could broadcast the sounds into the area around the wearer's ears. These side speaker devices could be self-powered, containing small battery compartments, or could be powered by a battery pack worn in the cushioned head cap, or strapped elsewhere on the body. The side sound projection devices also enable the participant to receive communications and commands from other personnel, such as coaches, co-players, co-participants, construction/factory team members, and law enforcement/military chains of command. This aspect of the invention provides a significant improvement and benefit over existing helmet designs, as a wearer could hear surrounding ambient noises even better than with the naked ear, adding the feature of holding secure communications with others.

A small, flat microphone (13) can be installed at the front of the dome to receive the wearer's oral communications. As with the side speaker unit, the microphone could be self-contained, containing small battery compartments, or could be powered by a battery pack worn in the cushioned head cap, or strapped elsewhere on the body. The software of the communication system should be designed to allow communication without detection by unintended listeners, such as military opponents or other teams, which end can be achieved through the use of digital scramblers, dedicated radio channels, or other coded means.

Figure 12:
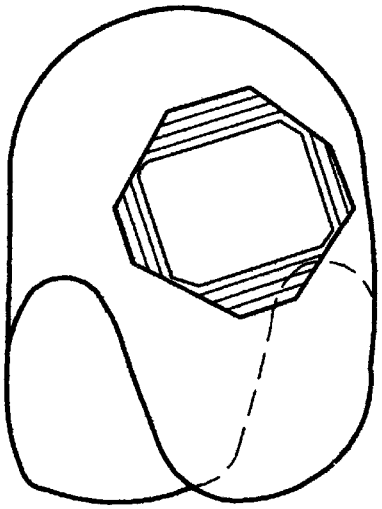
FIG. 12 is a side elevational view of the optional heating element system that could be housed within the dome.

Because it is important to maintain the wearer's unobstructed visibility through the head dome, the present invention contains various means to ensure that the dome remains clear of fog, ice, and other visual obstructions. In most climactic conditions, the climate control unit, in conjunction with the "anti-fog" solution on the inside of the dome and the and "anti-beading" solution of the outside of the dome, will keep the dome generally clear. In addition to these accessories, the dome could employ a series of embedded metallic coil/strip heating elements built integrally into the material of the dome, which would eliminate icing/fogging under extreme climactic conditions. FIG. 12. The embedded metallic coil/strip heating elements, known to those skilled in the art, are used in automobile and aircraft windshields, as well as in snowmobile face shields. The power for the embedded metallic coil/strip heating elements could derive from the power source used by the communications unit, or could be powered by a battery pack worn in the cushioned head cap, or strapped elsewhere on the body.

Figure 11:
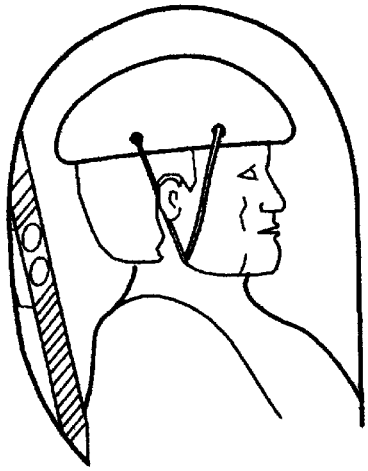
FIG. 11 is a side view of the optional climate control system that could be housed within the dome.

A small, unobtrusive climate control unit can be affixed at the back of the dome, as depicted in FIG. 11, for use in conjunction with the ventilation holes, to provide additional climate comfort within the dome. In frigid conditions, the unit could house an enclosed heating element, known to those skilled in the art, such as those currently used in automobiles and in snowmobile helmets. The unit would also house a small fan to circulate the heated air within the confines of the dome. In hot or humid conditions, the unit could house an enclosed refrigerating element. The unit would again house a small fan to circulate the cooled air within the confines of the dome. As with the communication and heating element systems, the climate control unit could be self-contained, containing small battery compartments, or could be powered by a battery pack worn in the cushioned head cap, or strapped elsewhere on the body. A single switch could operate all three devices, or each could have separate switches.

It is appreciated that various modifications to the inventive concepts, including the communication system and climate control unit, may be apparent to those skilled in the arts without departing from the spirit and scope of the invention. For example, in an alternative embodiment, the communication system could consist of earphone "buds" the wearer places in his ears, and the microphone bud could be affixed to the chin strap, the inside of the dome, the cushioned head cap, a piece of eye wear, or the wearer's face itself. Or, the communication system could be a one-piece, wrap-around-the-ear earphone and "boom microphone" system. It is noted that the National Football League® currently uses coach-to-quarterback technology that could be incorporated into the head dome. The military, law enforcement, surveillance and secret service personnel also utilize a wide variety of communication systems, many of which would easily adapt to the head dome concept, and are incorporated by reference into the present invention.

What is claimed is:

1. A head and spine protection system for use in high impact physical activities, comprising:

a. a shock-resistant, transparent head dome, of a diameter within a range between 8 and 20 inches, of a thickness of a range between 8 and 20 millimeters, enclosing with a suitable gap the entire head and neck of the wearer during high impact physical activities, which dome has two curved sections on opposite ends of two cylindrical downward extensions cut out in order for the lower edge of the dome to snugly contact and rest on the wearer's shoulders or shoulder pads, without leaving any appreciable gaps between the dome and the shoulders or shoulder pads, providing the wearer freedom of head and neck movement, unobstructed vision and comfort, and which dome is constructed of a material having high levels of mechanical, optical, electrical and thermal strength, and is capable when affixed to the wearer of protecting the head, skull, face, neck, cervical spine, and upper thoracic spine of the wearer by withstanding the impacts of persons wearing identical units, stationary objects, and projectiles, including bullets, rocks, bricks, or shrapnel, without significantly deforming, denting, cracking or shattering;

b. a cushioned head cap, of a diameter exceeding that of the wearer's skull by several inches but less than the diameter of the inner surface of the head dome by several inches, providing a soft padding for the head within the confines of the head dome, cushioning the face and head from whiplash, top, frontal, rear and lateral impact upon the exterior of the head dome, such that no part of the interior surface of dome can come in contact with the wearer's head or face following trauma to the exterior, which cushioned head cap is constructed of durable, soft, comfortable, suitably cushioning or inflatable material;

c. a cushioned head cap chin strap system, which straps are made of suitably tough strapping material, and which connect at between three and eight points on the cap to a connections system located under the wearer's chin;

d. four fastener slots cut through the dome material, with two cut into the lower corners of a front wing of a curved section of a cylindrical downward extension, and two cut into a rear wing of the other cylindrical downward extension, which slots are between ¼ to ½ inch in height and between ½ to 2 inches in width;

e. four fastener straps, which are attached to the four front and rear fastener slots, and which extend downward to the harness system, and which are constructed of a suitably strong, comfortable strapping material, and which have a degree of elasticity to firmly hold the head dome down onto the wearer's shoulders when tightened onto the harness system while providing enough elasticity to enable the wearer to bend in all directions comfortably;

f. a harness system to downwardly secure the four fastener straps to the stable lower body anchor of the wearer's legs and hips, which harness system includes a means to secure the four fastener straps to the waist/hips area of the wearer, and to manually adjust the strap length to an effective yet comfortable tension, and which harness system distributes the upward pull force of the straps to as large a percentage of the wearer's hips, upper legs, and waist to provide maximal comfort.

2. The system as defined in claim 1, where the dome is made of a polycarbonate resin with high impact resistance, dimensional stability, and visual clarity.

3. The system as defined in claim 1, where all or part of the dome's material is tinted and provides protection from solar ultra-violet rays.

4. The system as defined in claim 1, where the dome is made of a clear material resistant to deadly smoke, extreme heat, flames, gasses and nuclear/biological/chemical agents, such as a mica, for example aluminum oxide.

5. The system as defined in claim 1, where the shape of the dome is hemispherical, said hemisphere having a given diameter on top of the head dome, and extends downward into a cylindrical shape of the same given diameter.

6. The system as defined in claim 4, where the shape of the head dome varies as necessary to minimize size, to ease use, to accommodate some different use, to house desired components, or to suit aesthetic purposes, such as to cut out the face area of the dome and affix a conventional-appearing American football face mask, adapted to closely approximate the appearance of the current football helmet.

7. The system as defined in claim 1, where the lower edges of the curved dome's cylindrical downward extensions are cushioned by use of a perpendicular ridge of between 1 and 6 inches, which ridges have thick ridge padding material, made of synthetic foaming or padding materials, permanently attached underneath, such that the dome can be worn without the use of separate shoulder pads, as the padded, ridged curved lower rim of the dome rests directly onto the wearer's clothing, and provides adequate surface area over the wearer's shoulders to comfortably distribute the forces on the dome to the surface of the shoulders.

8. The system as defined in claim 1, where a series of small ventilation holes are cut through the head dome on various areas on the sides of the dome, which holes allow a free flow of oxygen into and carbon dioxide out from the dome, allowing the wearer to breathe normally, and which maintain visibility within the dome, by venting moisture and gasses.

9. The system as defined in claim 1, where the interior of the head dome is treated with an anti-fogging solution, such as those used on the insides of automobile windshields, ski goggles and snowmobile helmets, to prevent vision obstruction by fogging and icing.

10. The system as defined in claim 1, where the exterior of the head dome is treated with a solution that prevents the beading of water, such as the solutions used on automobile and aircraft windshields, to prevent vision obstruction by beading water droplets on the exterior of the dome.

11. The system as defined in claim 1, where the head dome is equipped with small side sound projection devices which are mounted onto the area of the dome near the ears, and which broadcast the sounds into the area around the wearer's ears, and which are powered by small battery compartments or a battery pack worn in the cushioned head cap, or strapped elsewhere on the body.

12. The system as defined in claim 10, where the side sound projection devices enable the participant to receive secure communications and commands via radio or digital technology from other personnel, such as coaches, co-players, coparticipants, construction/factory team members, and law enforcement/military chains of command.

13. The system as defined in claim 1, where the head dome is equipped with a small, flat microphone installed at the front of the dome to receive the wearer's oral communications and deliver them via radio or digital technology to other personnel, such as coaches, co-players, co-participants, construction/factory team members, and law enforcement/military chains of command, which communication system is designed to use digital scramblers, dedicated radio channels, or other coded means, and which are powered by small battery compartments or a battery pack worn in the cushioned head cap, or strapped elsewhere on the body.

14. The system as defined in claim 1, where the dome has a series of embedded metallic coil/strip heating elements built integrally into the material of the dome, which would eliminate icing/fogging under extreme climactic conditions, such as those used in automobile and aircraft windshields, as well as in snowmobile face shields, and which embedded metallic coil/strip heating elements are powered by small battery compartments or a battery pack worn in the cushioned head cap, or strapped elsewhere on the body.

15. The system as defined in claim 1, where a small, unobtrusive climate'control unit is affixed at the back of the dome to provide climate comfort within the dome, which provides either or both an enclosed heating element and an enclosed refrigerating element, which climate control unit houses a small fan to circulate the heated air within the confines of the dome, and which climate control unit is powered by small battery compartments or a battery pack worn in the cushioned head cap, or strapped elsewhere on the body.

* * * * *